US009111497B2

(12) United States Patent
Gamache et al.

(10) Patent No.: US 9,111,497 B2
(45) Date of Patent: Aug. 18, 2015

(54) APPARATUS AND ASSOCIATED METHODS FOR DYNAMIC SEQUENTIAL DISPLAY UPDATE

(75) Inventors: Bruce C. Gamache, Boulder, CO (US); Michael Yee, Broomfield, CO (US)

(73) Assignee: CITIZEN FINETECH MIYOTA CO., LTD (JP)

( * ) Notice: Subject to any disclaimer, the term of this patent is extended or adjusted under 35 U.S.C. 154(b) by 863 days.

(21) Appl. No.: 13/197,017

(22) Filed: Aug. 3, 2011

(65) Prior Publication Data

US 2013/0033530 A1 Feb. 7, 2013

(51) Int. Cl.

| | |
|---|---|
| ***G09G 3/36*** | (2006.01) |
| ***G09G 5/10*** | (2006.01) |
| ***G09G 5/00*** | (2006.01) |
| *G09G 3/34* | (2006.01) |

(52) U.S. Cl.

CPC ..... *G09G 3/3607* (2013.01); *G09G 3/3413* (2013.01); *G09G 2310/0235* (2013.01); *G09G 2330/021* (2013.01); *G09G 2360/16* (2013.01)

(58) Field of Classification Search

CPC ..... G09G 2310/0235; G09G 2023/0271; G09G 5/00; G09G 5/02; G09G 5/10; G09G 5/36; G09G 3/30; G09G 3/34; G09G 3/36; G09G 9/00; G09G 9/38; G09G 9/40; G06T 7/00; H04N 5/14; G02B 26/00

See application file for complete search history.

(56) References Cited

U.S. PATENT DOCUMENTS

| | | | | |
|---|---|---|---|---|
| 6,333,727 | B2 | 12/2001 | Mizumaki | |
| 6,873,320 | B2 | 3/2005 | Nakamura | |
| 7,283,105 | B2 | 10/2007 | Dallas et al. | |
| 7,283,114 | B2 | 10/2007 | Nishimura et al. | |
| 2006/0153446 | A1 * | 7/2006 | Oh et al. | 382/169 |
| 2007/0132680 | A1 * | 6/2007 | Kagawa et al. | 345/84 |
| 2009/0002285 | A1 * | 1/2009 | Baba et al. | 345/77 |
| 2011/0044542 | A1 * | 2/2011 | Kuwahara | 382/169 |
| 2012/0146990 | A1 * | 6/2012 | Kim | 345/214 |

FOREIGN PATENT DOCUMENTS

| | | |
|---|---|---|
| JP | 2004213418 | 7/2004 |

* cited by examiner

*Primary Examiner* — Aneeta Yodichkas
*Assistant Examiner* — Nguyen H Truong
(74) *Attorney, Agent, or Firm* — Holland & Hart LLP

(57) ABSTRACT

A controller and method have been described for use in conjunction with a sequential display system including a display having a plurality of pixels. A series of update cycles is performed on the display to establish the grayscale value of each pixel for viewing on the display based on the pixel values for a video frame by selectively switching each pixel responsive to the update cycles such that a total number of the update cycles is less than the total number of pixel values of the frame. Statistical characterization of frame data can be the basis of the reduction of the number of update cycles.

22 Claims, 8 Drawing Sheets

Pixel Column

| Pixel Row | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | 40 | 41 | 42 | 43 | 44 | 45 | 45 | 45 | 45 | 45 | 45 | 52 | 53 | 54 | 55 | 57 |
| 2 | 58 | 59 | 60 | 61 | 62 | 63 | 64 | 65 | 70 | 70 | 70 | 70 | 71 | 72 | 73 | 74 |
| 3 | 75 | 76 | 77 | 78 | 79 | 80 | 81 | 82 | 83 | 84 | 85 | 86 | 87 | 88 | 89 | 90 |
| 4 | 40 | 41 | 42 | 43 | 44 | 45 | 45 | 45 | 45 | 45 | 45 | 52 | 53 | 54 | 55 | 57 |
| 5 | 58 | 59 | 60 | 61 | 62 | 63 | 64 | 65 | 70 | 70 | 70 | 70 | 71 | 72 | 73 | 74 |
| 6 | 75 | 76 | 77 | 78 | 79 | 80 | 81 | 82 | 83 | 84 | 85 | 86 | 87 | 88 | 89 | 90 |
| 7 | 40 | 41 | 42 | 43 | 44 | 45 | 45 | 45 | 45 | 45 | 45 | 52 | 53 | 54 | 55 | 57 |
| 8 | 58 | 59 | 60 | 61 | 62 | 63 | 64 | 65 | 70 | 70 | 70 | 70 | 71 | 72 | 73 | 74 |
| 9 | 75 | 76 | 77 | 78 | 79 | 80 | 81 | 82 | 83 | 84 | 85 | 86 | 87 | 88 | 89 | 90 |

Red Subframe 1 Pixel Value Set

APPARATUS AND ASSOCIATED METHODS FOR DYNAMIC SEQUENTIAL DISPLAY UPDATE

BACKGROUND

The present invention is generally related to the field of field sequential displays and, more particularly, to the field of dynamically updating the frames of a field sequential display.

There are a number of competing technologies in the field of modern displays. One particularly advantageous type of modern display is the field sequential display using a ferroelectric liquid crystal on silicon (FLCOS) pixel array. The pixel array of the FLCOS display is capable of extremely fast switching such that it is ideally suited to the display of real time video. Some of these displays have been configured for illumination by LEDs, however, other suitable light sources can be used. These displays can offer a bright and accurate image across a wide range of operating conditions from a very small package. Projection type FLCOS display arrangements with LED-based light engines have been successfully integrated in portable, battery powered devices such as, for example, cellular telephones.

A field sequential display generally presents video to a viewer by breaking the frames of an incoming video stream into subframes of individual red, green and blue subframes. Only one color subframe is presented to the viewer at a time. That is, the pixels of the pixel array can be illuminated at different times by an appropriate color of light associated with the red, green and blue subframes in a way that produces a grayscale image for each subframe. The color subframes can be presented to the viewer so rapidly, however, that the eye of the viewer integrates the individual color subframes into a full color image. In the instance of an incoming video stream, the processing for purposes of generating the subframes is generally performed in real time while the pixels of the display are likewise driven in real time.

The foregoing examples of the related art and limitations related therewith are intended to be illustrative and not exclusive. Other limitations of the related art will become apparent to those of skill in the art upon a reading of the specification and a study of the drawings.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles taught herein may be applied to other embodiments. Thus, the present invention is not intended to be limited to the embodiments shown, but is to be accorded the widest scope consistent with the principles and features described herein including modifications and equivalents, as defined within the scope of the appended claims. It is noted that the drawings are not to scale and are diagrammatic in nature in a way that is thought to best illustrate features of interest. Descriptive terminology may be adopted for purposes of enhancing the reader's understanding, with respect to the various views provided in the figures, and is in no way intended as being limiting.

Figure 1:
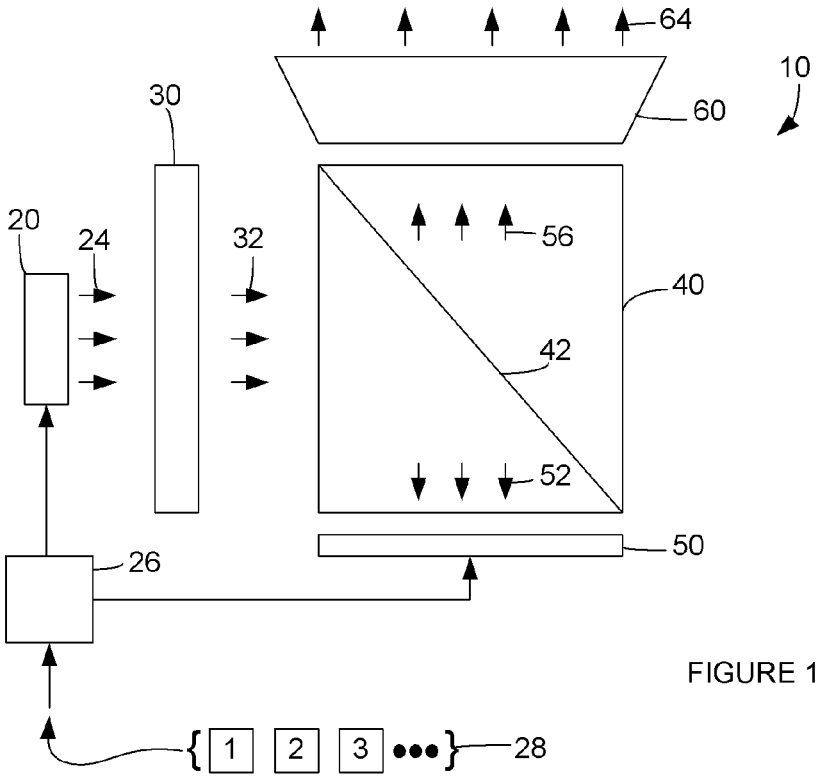
FIG. 1 is a diagrammatic illustration of a system in block diagram form that is configured for operation according to the present disclosure.

Attention is now directed to the figures wherein like items may refer to like components throughout the various views. FIG. 1 is a diagrammatic representation of a display arrangement, produced according to an embodiment of the present disclosure, and generally indicated by the reference number 10. It is noted that optical elements such as, for example, various lens arrangements can form part of display arrangement 10 as will be recognized by those of ordinary skill in the art, however, these elements have not been shown for purposes of illustrative clarity. A light source 20 which can, for example, comprise LEDs emits non polarized light 24 which is indicated by arrows. The light source is driven by a controller 26 to selectively emit light, which can be white light in one embodiment for producing a monochrome display. In another embodiment, the light source can selectively emit colored light such as, for example, red, green and blue light, as will be further described at an appropriate point hereinafter. In the instance of either, white or color light, one or more lenses can handle light 24 such that the light is of sufficiently uniformity for illuminating a given microdisplay having a given shape and a given aspect ratio, as will be further described. Controller 26 generates signals based on an input signal 28 that can be an incoming video stream that is made up of frames, three of which are shown and labeled as 1, 2 and 3. Light 24 is polarized by a polarizer arrangement 30. In the instance of light source 20 initially emitting polarized light, however, polarizer arrangement 30 may not be needed. In the present embodiment, polarized light 32 can then enter a polarizing beam splitter (PBS) 40. A beam splitting hypotenuse face 42 of the PBS reflects the polarized light onto a display such as, for example, an FLCOS microdisplay 50. With respect to PBS 40, it should be appreciated that other embodiments can use another suitable form of polarization dependent reflective arrangement such as, for example, a reflective polarizer. Moreover, future embodiments may not require polarized light. The reflected polarized light is indicated by the reference number 52 and is represented using arrows. The microdisplay selectively modulates and reflects the incoming light to produce modulated output light 56. When a given pixel is in an off state, the polarization of light reflected from the given pixel is rejected by PBS 40 whereas when the given pixel is an on state, the polarization of the reflected light is switched and therefore passes through the PBS as modulated output light 56. The modulated output light can be received by a projection lens arrangement 60 and emitted as projection light 64 which can be incident upon any suitable surface for purposes of viewing. The present disclosure considers the use of a projection light engine for descriptive purposes, however, the teachings herein are not limited to projection light engines but are equally applicable with respect to any form of field sequential display. While the present disclosure remains applicable to any suitably shaped display having any suitable aspect ratio, the disclosure will consider the use of a 16 by 9 display.

Figure 2:
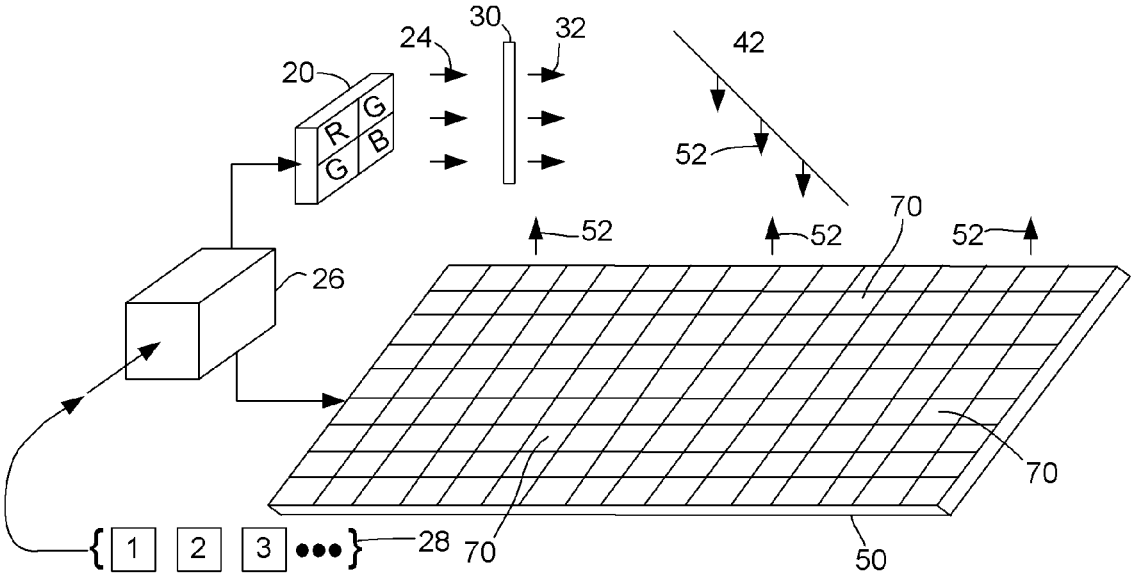
FIG. 2 is a perspective view of certain components of the system of FIG. 1, shown here to illustrate features of their operation.

Referring to FIG. 2 in conjunction with FIG. 1, the former diagrammatically illustrates at least the components of display arrangement 10 that are controlled by controller 26. In particular, controller 26 is in electrical communication with light source 20 and microdisplay 50. In the illustrated embodiment, light source 20 includes a red LED (R), a blue LED (B) and a pair of green (G) LEDs for purposes of emitting light, which will be familiar to those of ordinary skill in the art. Microdisplay 50 is shown in a diagrammatic perspective view to illustrate the presence of an array of pixels, several individual ones of which pixels are indicated by the reference number 70. Each of 9 rows of pixels includes 16 pixel columns, as illustrated, to make up the 16 by 9 display.

Figure 3:
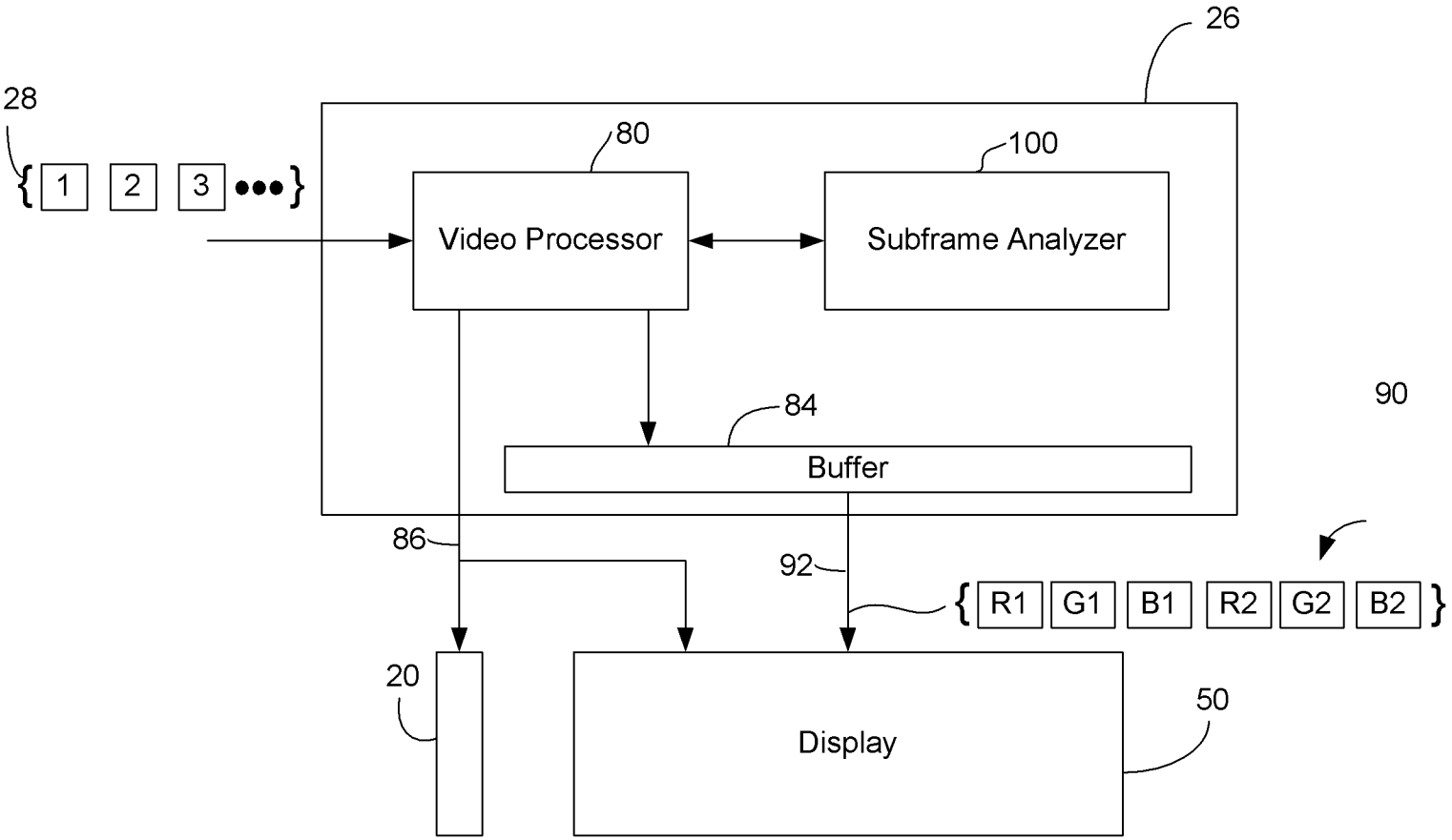
FIG. 3 is a block diagram illustrating a controller, light source and display of the system of FIG. 1, shown here to illustrate further details of their operation.

Attention is now directed to FIG. 3 which illustrates system 10 including an embodiment of controller 26 of FIGS. 1 and 2 shown in block diagram form. Controller 26 includes a video processor 80 that can operate on input video stream 28 in real time to generate individual color subframes associated with each color that light source 20 can emit. As will be further described, the data for each subframe specifies a grayscale value for each pixel of display 50. For purposes of the present descriptions as well as the appended claims, the terms frame and subframe can refer to any collection of grayscale data that specifies a grayscale value for each pixel of the display that is in use. For example, in the instance of monochrome video, the frame itself can be treated as a subframe and directly displayed on the display in the same manner as an individual color subframe, as described herein, for color video. Data associated with subframes can be stored in a data buffer 84 and loaded into display 50 with appropriate timing, as will be familiar to one having ordinary skill relating to field sequential color displays based on control signals provided on control lines 86 to display 50 and light source 20. While FIG. 3 illustrates a single buffer for purposes of illustrative clarity, a separate buffer can be provided for each subframe color. A subframe set is generally indicated by the reference number 90 as can be transferred on data lines 92 and can be associated with any one of the incoming frames of input video stream 28. Control lines 96 provide for control of display 50 in coordination with illumination from light source 20 such that each subframe is illuminated by the appropriate color of light and each pixel is modulated appropriately to provide a desired grayscale value. In the present example, each subframe set includes a series of a first red, green and blue subframes followed by a second series of red, green and blue subframes such that each subframe set includes two subframes for each color. It is noted that presentation of the subframes to the viewer in this manner can serve to aid the eye of the viewer in integrating the subframe images for presentation of video at standard rates such as 60 frames per second, although any suitable number and/or sequence of subframes can be used. Of course, a monochrome display may use fewer subframes per frame of incoming video since individual colors are not required. Irrespective of the color makeup of light that is used to illuminate display 50, the display modulates the illuminating light and generates a grayscale image for that illuminating light.

It should be appreciated that color sequential displays generally display each subframe using a series of update cycles that is directly based on the number of grayscale values that is available for each pixel. By way of example, in a 7 bit grayscale scheme, there are 128 gray scale values (0-127) available for each pixel. When using this number of grayscale levels, a prior art color sequential display typically performs one update cycle for each grayscale level such that 128 update cycles would be performed in order to display a single subframe. In effect, it is as if each subframe is itself divided into 128 subframes. As will be described, immediately hereinafter, Applicants have recognized different approaches with respect to performing update cycles.

Still referring to FIG. 3, a subframe analyzer 100 operates in conjunction with video processor 80 to generate statistics relating to subframes of the incoming video frames. These statistics can be generated in real time on a pixel-by-pixel basis and implemented in hardware, software or an appropriate combination thereof. Any suitable statistic can be generated based on an incoming video frame or subframe, for example, relating to grayscale values that have been assigned to the pixels. The present example will consider the seven bit grayscale scheme described above wherein there are 128 possible grayscale values that can be designated as 0-127. Applicants recognize that even though any pixel of a given subframe can at least potentially have any one of the possible grayscale values, certain characteristics of the incoming video may impose statistical limits on the pixel values such that performing updates in view of these statistics can provide benefits. For example, the incoming video can represent a dark scene in a movie such as a night time scene. In this case, there can be an uppermost (e.g., maximum) statistical limit for an overall set of grayscale pixel values for the given subframe. Conversely, the incoming video can represent a bright scene in a movie such as seen in bright daylight or a cartoon scene. In this case, there can be a lowermost (e.g., minimum) statistical limit for the overall set of grayscale pixel values for the given subframe. In still another example, a given subframe can exhibit a range of pixel grayscale values having both a lowermost limit and an uppermost limit. Further, statistical analysis can indicate that certain pixel grayscale values are missing in the given subframe, irrespective of lowermost and uppermost limits. Specific examples of these various situations will be considered hereinafter in conjunction with details relating to the operation of subframe analyzer 100.

Figure 4:
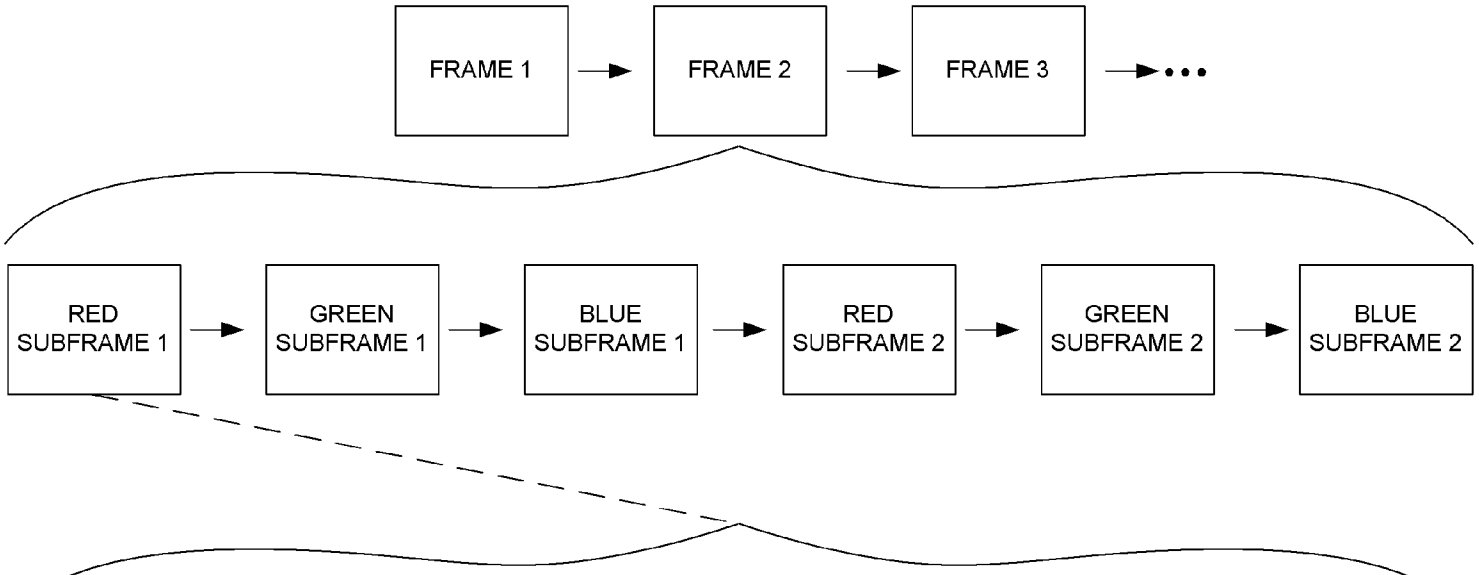
FIG. 4 is a diagrammatic illustration of a video stream made up of frames that is used by the controller of FIGS. 1-3 to produce a series of color subframes and further demonstrates a hypothetical set of pixel values, for explanatory purposes, presented on the display of FIGS. 1-3 for a subframe.

Attention is now directed to FIG. 4 which diagrammatically illustrates three frames labeled as Frame 1-3, taken from video stream 28. As is shown for Frame 2, each frame can be used to generate 6 color subframes that are labeled as Red Subframe 1, Green Subframe 1, Blue Subframe 1, Red Subframe 2, Green Subframe 2 and Blue Subframe 2. In the present example, display 50 is shown having a pixel array that is limited to 144 pixels in a 16 by 9 arrangement for purposes of illustrative clarity. Specific grayscale pixel values are given within the area of each pixel, by way of example, for Red Subframe 1. It is noted that these pixel values are not derived from an actual video frame but are hypothetical and have been selected for purposes of illustrating the methods that are being brought to light by the present disclosure. One of ordinary skill in the art, however, will appreciate that there is no difference with respect to the application of these methods to actual video/subframe data, although not every subframe may exhibit every statistical characteristic in the manner of the hypothetical subframe. In the present example, 7 bit grayscale pixel values are in use such that the grayscale value for any given pixel can potentially be any value in the range of 0-127. Any suitable number of grayscale pixel values can be used. For purposes of the present disclosure, grayscale values for each pixel can be operationally achieved solely by switching each pixel between an "off" state and an "on" state such that light that is reflected in one state is opposite in polarization to the reflected light in the other state. In some embodiments, however, the intensity of light emitted by light source 20 can be modulated in cooperation with pixel switching to achieve grayscale values while remaining within the scope of the teachings herein.

Figure 5:
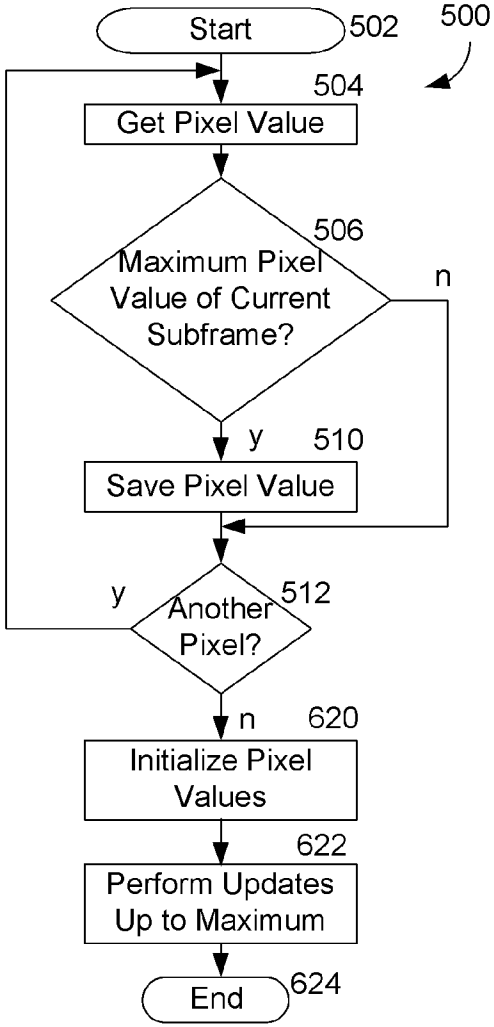
FIG. 5 is a flow diagram that illustrates a method for the operation of the system of FIG. 1 which can detect a maximum grayscale pixel value in a subframe and avoid update cycles above the maximum grayscale value.

Turning now to FIG. 5, a flow diagram illustrates an embodiment, generally designated by the reference number 500, of a method for operating subframe analyzer 100 of FIG. 3. Method 500 is illustrated as operating on Red Subframe 1 having the grayscale pixel values provided on display 50 as shown in FIG. 4. The method begins at start 502 and proceeds to 504 which retrieves the first grayscale pixel value which is 40 for pixel (1,1) wherein the pixel is identified by (column #, row#) as shown in FIG. 4. At 506, the grayscale value for the current pixel is tested to determine whether the current value is a maximum value for the subframe. Since the first pixel is being handled, the value 40 is a current maximum value. Thus, the value 40 is saved at 510. At 512, the availability of another grayscale pixel value is confirmed. Since at least one more grayscale pixel value is available to be tested against the current maximum grayscale value, operation returns to 504 which retrieves the next pixel grayscale value. In the present example, pixels are handled on a row-by-row basis although this is not a requirement. That is, pixels can be tested column-by-column or in any suitable manner so long as a maximum value can be identified from among the sum total of values. Since the retrieved value for pixel (2,1) is 41, a new maximum grayscale value is identified as confirmed by step 506 and thereafter stored as such by step 510. Step 512 then proceeds to test pixel (3,1). It should be appreciated that step 510 is skipped by step 506 for any instance of a current grayscale value that is less than the current saved maximum grayscale value. Operation of method 500 proceeds in a loop until the grayscale values of all of the pixels have been tested and the maximum grayscale value identified. In the present example, the maximum grayscale pixel value is identified as 90, for example, at pixel (16, 3) in FIG. 4. It should be appreciated that finding an instance of an uppermost limit pixel value (127) could provide an exit point to the present process since the full range of grayscale pixel values is in use.

Figure 6:
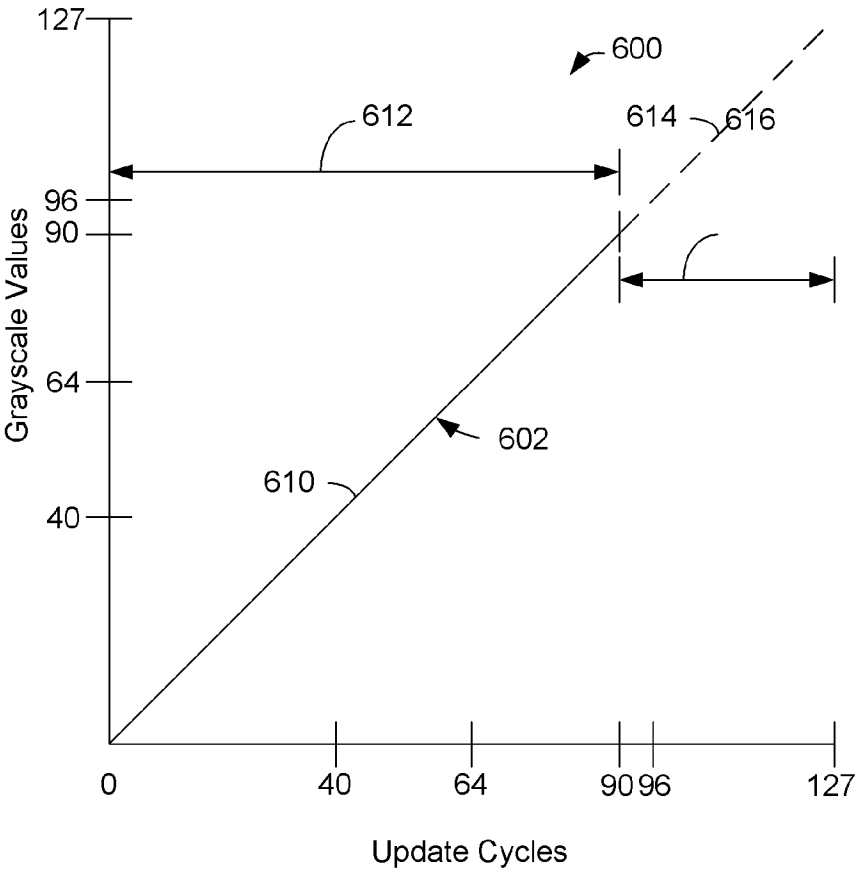
FIG. 6 is a graphical representation of an update ramp for purposes of illustrating the operation of the method of FIG. 5.

Referring to FIG. 6 in conjunction with FIGS. 4 and 5, the former is a plot, generally indicated by the reference number 600, which illustrates potential grayscale values along the vertical axis against update cycles along the horizontal axis for 7 bit grayscale values, shown here to illustrate an update ramp 602 that is based on the statistical identification of the maximum grayscale value of 90 as determined by method 500. It should be appreciated that method 500 remains applicable irrespective of the particular position of the maximum grayscale value within the overall grayscale range. A first portion 610 of update ramp 602 is shown as a solid line corresponding to a first range 612 of grayscale values to indicate grayscale values up to and including the maximum grayscale pixel value (values 0-90) while a second portion 614 of the update ramp is shown as a dashed line corresponding to a second range 616 of grayscale values above the maximum grayscale value (values 91-127).

Having identified the maximum grayscale value, method 500 continues at step 620 which initializes all pixel values, for example, by switching all of the pixels to an "off" state. Operation then proceeds to step 622 which performs update cycles for grayscale values up to and including maximum grayscale value 90 such that each pixel can be switched on and off during these update cycles as appropriate based on the associated grayscale pixel value. Once operation reaches the maximum grayscale value, however, all of the pixels can be switched to the "off" state. That is, when the update cycle corresponding to grayscale level 90 is performed. Update cycles above grayscale value 90 are not performed. That is, update cycles from grayscale value 0-90 are performed while update cycles for grayscale values from 91 to are not performed. During interval 616, light source 20 can remain "on". Applicants recognize that by limiting the update cycles to only grayscale values up to maximum grayscale value 90 for the example subframe, power savings can be provided, as compared to a conventional color sequential display that performs all update cycles irrespective of the statistical presence of a maximum grayscale value in a subframe. Further, there is no influence on the actual appearance of the subframe to the viewer. The power savings can be attributed at least to avoiding unnecessary memory accesses to the frame buffer, unnecessary update cycles to the pixel array and to limiting the operation of control logic during time interval 612. Such power savings can be of particular value in the instance of a display arrangement that forms part of a portable battery powered device such as, for example, a cellular telephone. Method 500 then ends at 624.

Figure 7:
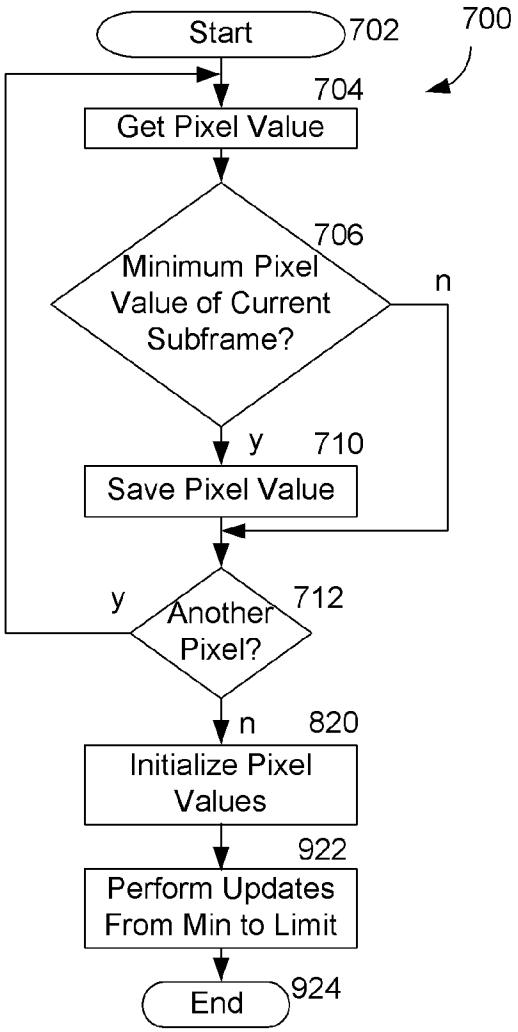
FIG. 7 is a flow diagram that illustrates a method for the operation of the system of FIG. 1 which can detect a minimum grayscale pixel value in a subframe and avoid update cycles below the minimum grayscale value.

Turning now to FIG. 7, a flow diagram illustrates another embodiment of a method, generally designated by the reference number 700, for operating subframe analyzer 100 of FIG. 3. Like method 500, method 700 is illustrated as operating on Red Subframe 1 having the grayscale pixel values provided on display 50 as shown in FIG. 4. The method begins at start 702 and proceeds to 704 which retrieves the first grayscale pixel value that is 40 for pixel (1,1) wherein the pixel is identified by (column #, row#) as shown in FIG. 4. At 706, the grayscale value for the current pixel is tested to determine whether the current value is a minimum value for the subframe. Since the first pixel is being handled, the value 40 is a current minimum value. Thus, the value 40 is saved at 710. At 712, the availability of another pixel, for comparison purposes, is confirmed. Since at least one more pixel is available to be tested against the current minimum grayscale value, operation returns to 704 which retrieves the next pixel grayscale value. As described above, pixels are handled on a row-by-row basis in the examples provided herein although this is not a requirement. Since the retrieved value for pixel (2,1) is 41, step 706 causes operation to proceed directly to step 712, skipping step 710. Step 712 then tests for the availability of another pixel and returns operation to step 704 to test pixel (3,1). Operation of method 700 proceeds in a loop until the grayscale values of all of the pixels have been tested and step 712 exits the loop. In the present example, the minimum grayscale pixel value is identified as 40, for example, at pixel (1, 1) in FIG. 4. It should be appreciated that finding an instance of an uppermost limit pixel value (127) could provide an exit point to the present process since the full range of grayscale pixel values is in use. It should be appreciated that finding an instance of an lowermost limit pixel value (0) could provide an exit point to the present process since the full range of grayscale pixel values is in use.

Figure 8:
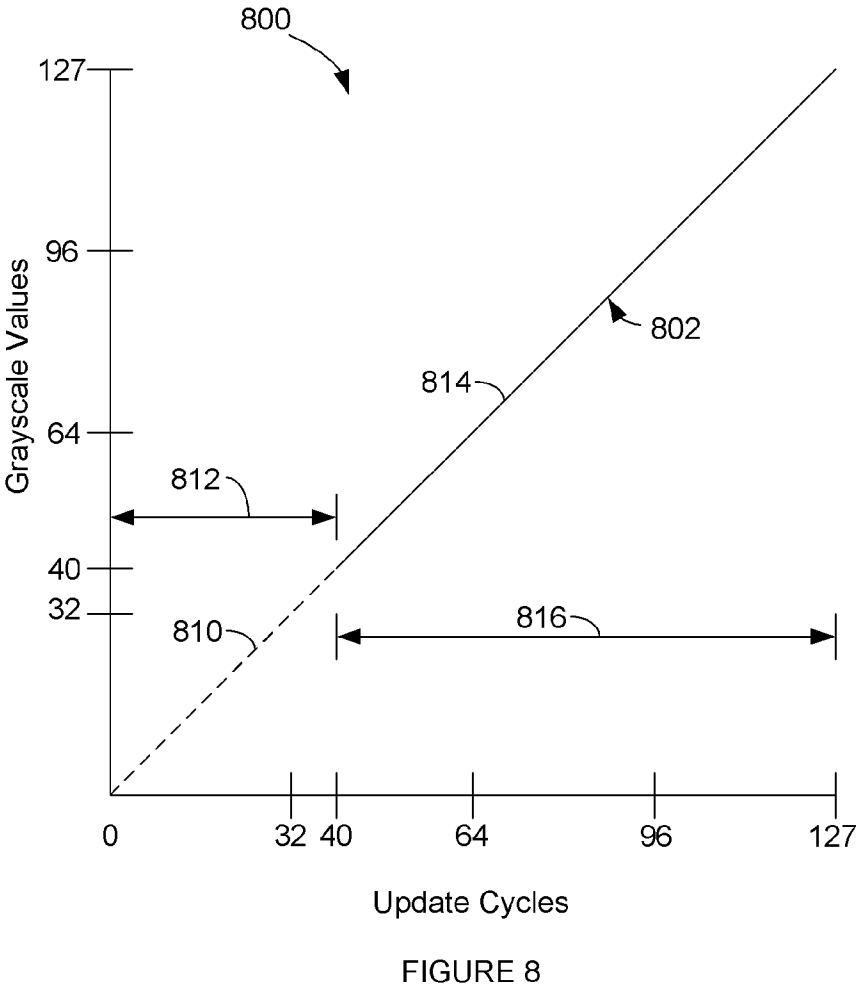
FIG. 8 is a graphical representation of an update ramp for purposes of illustrating the operation of the method of FIG. 7.

Referring to FIG. 8 in conjunction with FIGS. 4, 6 and 7, the former is a plot, generally indicated by the reference number 800, which illustrates potential grayscale values along the vertical axis against update cycles along the horizontal axis for 7 bit grayscale values, shown here to illustrate an update ramp 802 that is based on the statistical identification of the minimum grayscale value of 40 as determined by method 700. It should be appreciated that method 700 remains applicable irrespective of the particular position of the minimum grayscale value within the overall grayscale range shown in FIG. 8. A first portion 810 of update ramp 802 is shown as a dashed line corresponding to a first range 812 of grayscale values to indicate grayscale values up to the minimum grayscale pixel value (values 0-39) while a second portion 814 of the update ramp is shown as a solid line corresponding to a second range 816 of grayscale values including and above the minimum grayscale value (values 40-127).

Having identified the minimum grayscale value, method 700 continues at step 820 which initializes the pixel values, for example, by turning all of the pixels to an "on" state since all of the pixels are to remain in the on state at least until the update cycle is performed that corresponds to the minimum grayscale value of the subframe. That is, all of the pixels are to remain in the on state until the update cycle corresponding to grayscale pixel value 40 is performed at which time pixels having grayscale value 40 can be switched to the off state. At step 822, update cycles for grayscale values from minimum grayscale value 40 up to the upper limit grayscale value of 127 are performed. Update cycles below minimum grayscale value 40 are not performed since all of the pixels are in the "on" state below this minimum value. That is, update cycles from grayscale value 0-39 are not performed while update cycles for grayscale values from 40 to 127 are performed. Applicants recognize that by limiting the update cycles to only grayscale values including and above the minimum grayscale value 40 for the example subframe, power savings can be provided, as compared to a conventional color sequential display that performs all update cycles irrespective of the presence of a minimum grayscale value in a subframe. Further, there is no influence on the actual appearance of the subframe to the viewer. The power savings can be attributed at least to avoiding unnecessary memory accesses to the frame buffer, unnecessary update cycles to the pixel array and to limiting the operation of control logic during time interval 812. Method 700 then ends at 824.

Figure 9:
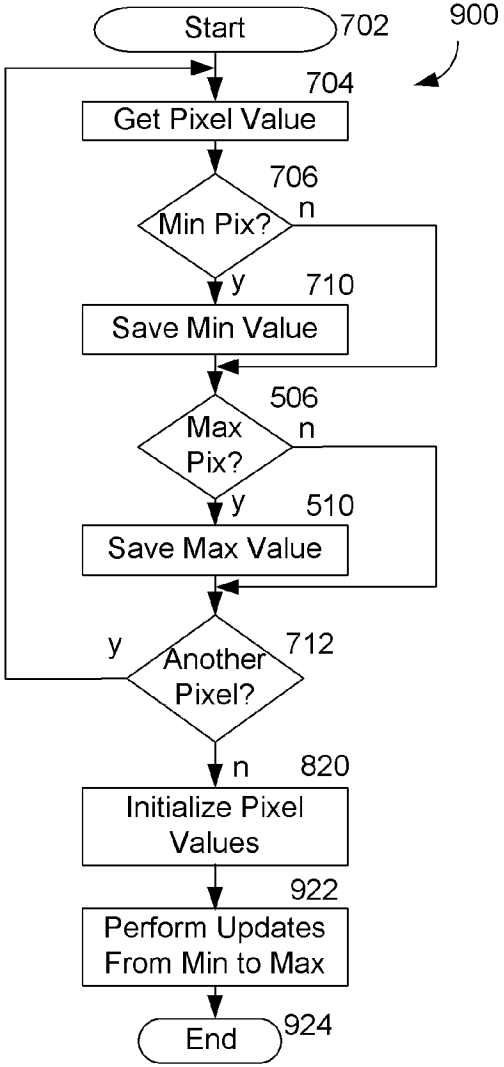
FIG. 9 is a flow diagram that illustrates a method for the operation of the system of FIG. 1 which can detect a minimum and a maximum grayscale value in a subframe and limit update cycles to those grayscale values including and between the minimum and maximum grayscale values.

Turning now to FIG. 9, a flow diagram illustrates another embodiment of a method, generally designated by the reference number 900, for operating subframe analyzer 100 of FIG. 3. Like aforedescribed methods 500 and 700, method 900 is illustrated as operating on Red Subframe 1 having the grayscale pixel values provided on display 50 as shown in FIG. 4. Since method 900 concurrently tracks both the minimum grayscale value and the maximum grayscale value in the subframe, like reference numbers have been applied when practical and taken from method 700. Accordingly, the method begins at start 702 and proceeds to 704 which retrieves the first grayscale pixel value which is 40 for pixel (1,1) wherein the pixel is identified by (column #, row#) as shown in FIG. 4. At 706, the grayscale value for the current pixel is tested to determine whether the current value is a minimum value for the subframe. Since the first pixel is being handled, the value 40 is a current minimum value. Thus, the value 40 is saved at 710. As the process loops through step 706, it is noted that step 710 will update the current minimum value each time the value for the current pixel is less than the current saved minimum grayscale pixel value. For the example grayscale values seen in FIG. 3, the value 40 is the minimum overall grayscale value. At 506, the grayscale value for the current pixel is tested to determine whether the current value is a maximum for the subframe. Since the first pixel is being handled, the value 40 is the current maximum pixel value such that the process saves the current maximum value at step 510. As the method loops through step 506, the current maximum pixel value will be updated by step 510 each time a new current maximum pixel value is found. For the example grayscale values under consideration, the value 90 is identified as the maximum pixel grayscale value. Step 712 monitors for the availability of another grayscale pixel value to test until all of the pixels have been tested in a loop-wise fashion. As described above, pixels are handled on a row-by-row basis in the examples provided herein although this is not a requirement. In the present example, the minimum grayscale pixel value is identified as 40, for example, at pixel (1, 1) in FIG. 4 while the maximum grayscale pixel value is identified as 90, for example, at pixel (16, 3).

Figure 10:
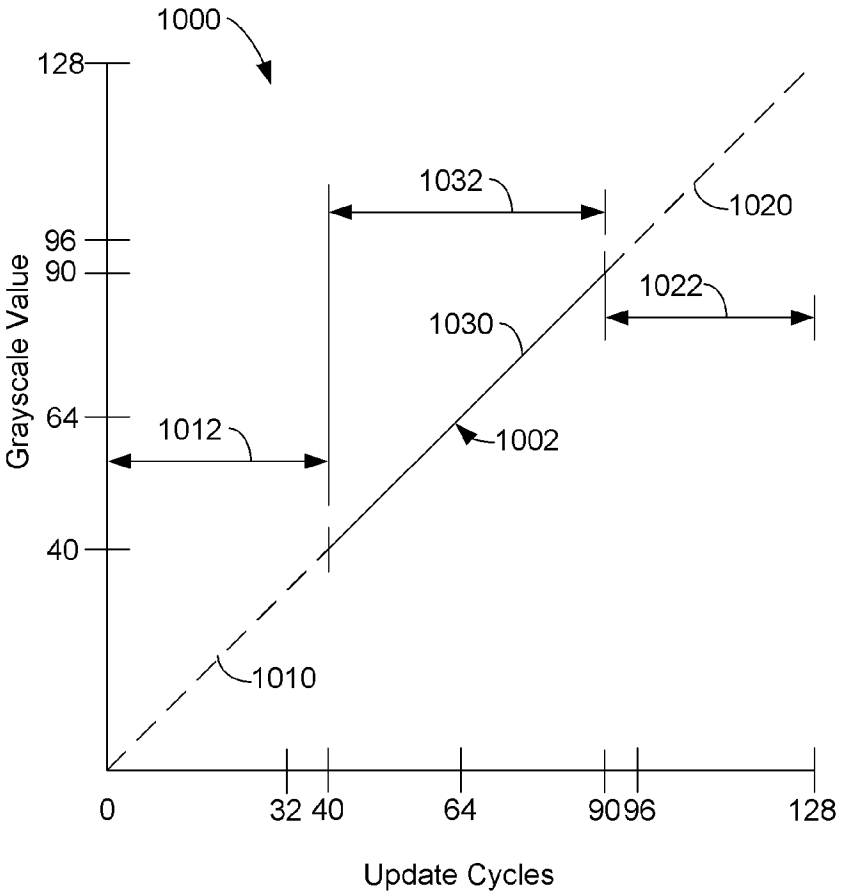
FIG. 10 is a graphical representation of an update ramp for purposes of illustrating the operation of the method of FIG. 9, including an intermediate range of grayscale values having a minimum and maximum grayscale value.

Referring to FIG. 10 in conjunction with FIGS. 4 and 9, the former is a plot, generally indicated by the reference number 1000, which illustrates potential grayscale values along the vertical axis against update cycles along the horizontal axis for 7 bit grayscale values, shown here to illustrate an update ramp 1002 that is based on the statistical identification of the minimum grayscale value of 40 and the maximum grayscale value of 90, as determined by method 900. It should be appreciated that method 900 remains applicable irrespective of the particular positions of the minimum and maximum grayscale values within the overall grayscale range. A lower portion 1010 of update ramp 1002 is shown as a dashed line corresponding to a low range 1012 of grayscale values to indicate grayscale values from grayscale value 0 up to the minimum grayscale pixel value (values 0-39). An upper portion 1020 of update ramp 1002 is shown as a dashed line corresponding to a high range 1022 of grayscale values to indicate grayscale values above the maximum grayscale pixel value up to the 7 bit grayscale limit value (values 91-127). An intermediate portion 1030 of update ramp 1002 is shown as a solid line corresponding to an intermediate range 1032 of grayscale values to indicate grayscale values from minimum grayscale value 40 to maximum grayscale pixel value 90, inclusive (values 40-90). Of course, if the minimum grayscale value is 0, the appearance of FIG. 10 would correspond to that of FIG. 6 whereas, if the maximum grayscale value is 127, the appearance of FIG. 10 would correspond to that of FIG. 8.

Having identified the presence of an intermediate range of grayscale values between a minimum grayscale value and a maximum grayscale value, method 900 continues at step 820 which initializes the pixel values of the subframe, for example, by setting all of the grayscale values of the pixels to the "on" state due to the presence of a minimum grayscale pixel value. That is, all of the pixels are to remain in the on state until the update cycle corresponding to grayscale pixel value 40 is performed at which time pixels having grayscale value 40 can be switched to the off state. At step 922, update cycles are performed for grayscale values from the minimum grayscale value 40 up to the maximum grayscale value 90. Update cycles below minimum grayscale value 40 are not performed. That is, update cycles from grayscale value 0-39 are not performed while update cycles for grayscale values from 40 to 90 are performed. When step 922 reaches the maximum grayscale value of 90 at the update corresponding to this grayscale level, all of the pixels can be switched to the off state and remain in the off state for the balance of the subframe corresponding to grayscale levels 91-127. Applicants recognize that by limiting the update cycles to only grayscale values from the minimum to the maximum grayscale values of 40 and 90, respectively, for the example subframe, power savings can be provided, as compared to a conventional color sequential display that performs all update cycles irrespective of the presence of minimum and maximum grayscale values in a subframe. Further, there is no influence on the actual appearance of the subframe to the viewer, as described above. Method 900 then ends at 924.

Figure 11:
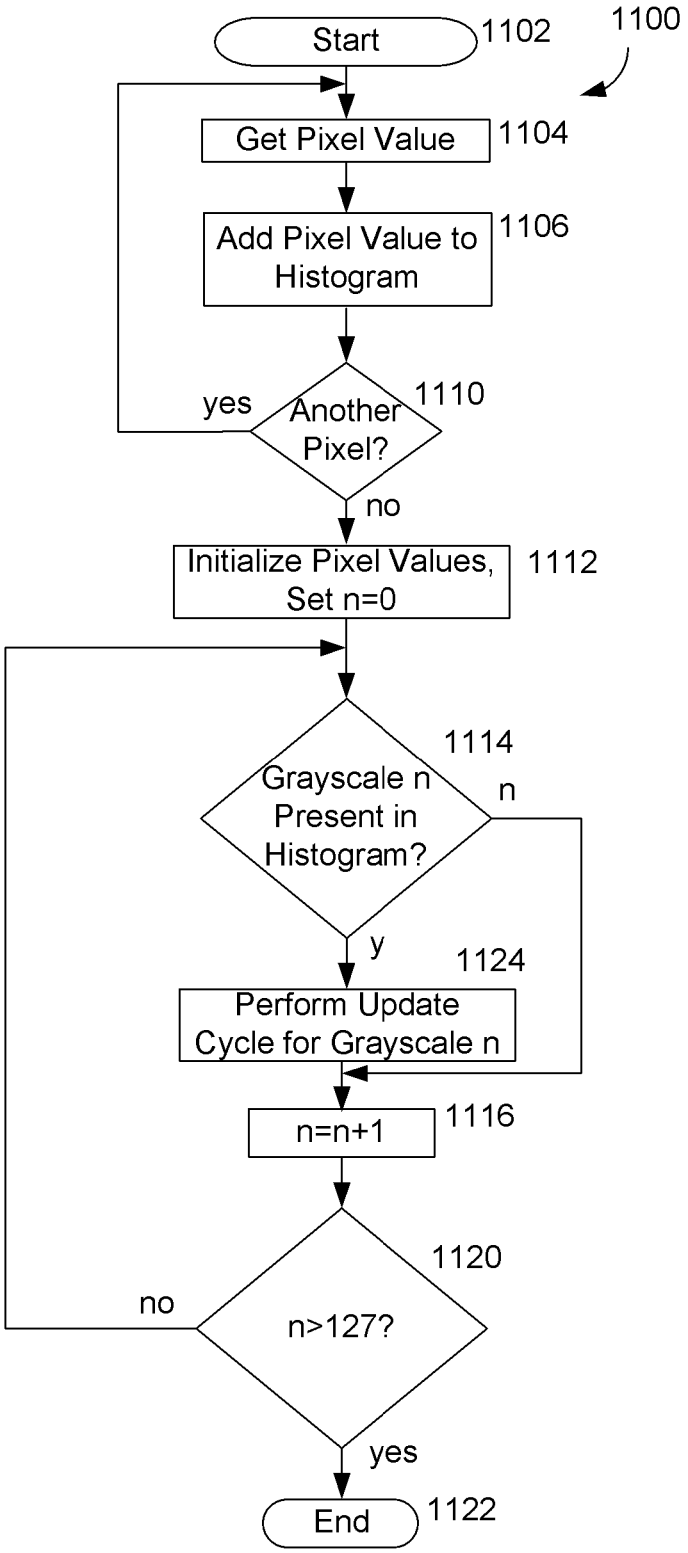
FIG. 11 is a flow diagram that illustrates a method for the operation of the system of FIG. 1 which operates on the basis of generating histogram data characterizing the occurrence of each grayscale value in a subframe and limiting update cycles to only those grayscale values that exhibit at least one occurrence in the subframe.

FIG. 11 is a flow diagram which illustrates another embodiment of a method, generally designated by the reference number 1100, for operating subframe analyzer 100 of FIG. 3. Like aforedescribed methods 500, 700 and 900, method 1100 is illustrated as operating on Red Subframe 1 having the grayscale pixel values provided on display 50 as shown in FIG. 4. The method begins at start 1102 and proceeds to 1104 which retrieves the first grayscale pixel value which is 40 for pixel (1,1) wherein the pixel is identified by (column #, row#) as shown in FIG. 4. At 1106, the grayscale value for the current value is tabulated as data that provides a contribution to a histogram designating the number of occurrences of each grayscale value for the current subframe. Step 1110 tests for remaining pixels having grayscale values that have not yet contributed to the histogram data. So long as at least one pixel is available to provide a grayscale value to the histogram data, the method loops through steps 1104, 1106 and 1110. Once the grayscale levels for all pixels have been accounted for, operation proceeds to step 1112 which can initialize all of the pixels of display 50 to an on state for display purposes and set a counter variable n to zero, for reasons which will be evident based on the discussions which follow.

Figure 12:
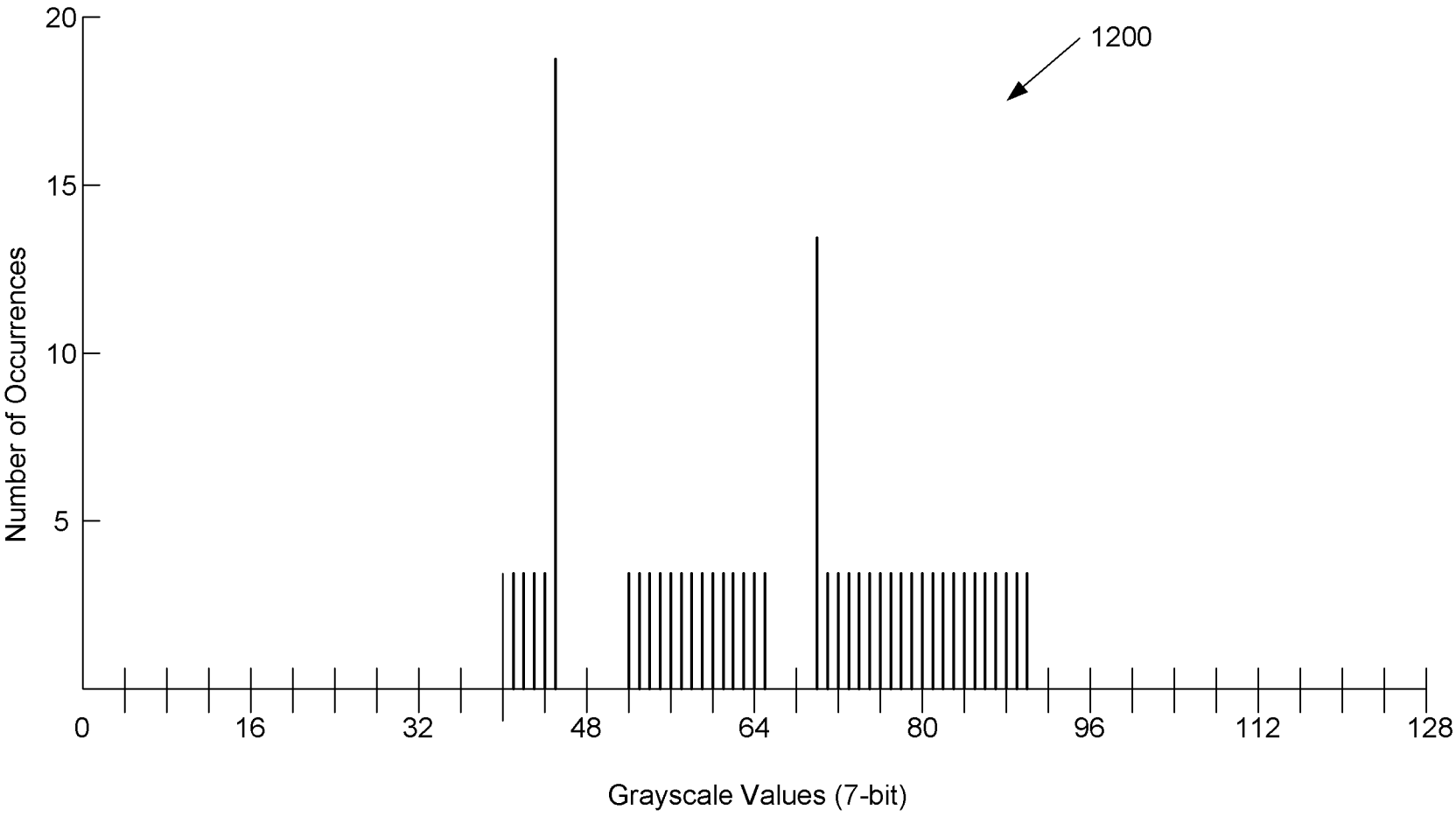
FIG. 12 is a graphical representation of a histogram based on grayscale pixel values for a given subframe for purposes of illustrating the operation of the method of FIG. 11.

Referring to FIG. 12 in conjunction with FIGS. 4 and 11, FIG. 12 is a histogram, generally indicated by the reference number 1200, that can be produced by the initial steps of method 1100. The vertical axis of the histogram indicates the number of occurrences of each grayscale value taken from Red Subframe 1 of FIG. 4 plotted against a horizontal axis that indicates each 7 bit grayscale value by way of example, since the method is equally applicable with respect to any number of grayscale values. It is evident that there are no pixels having grayscale levels 0-39, 46-51, 66-69 and 91-127 such that there are 5 separate ranges of what can be referred to as missing (e.g., unused) pixel values spaced apart by ranges of grayscale pixel values that are present in the histogram. In particular, grayscale values 40-44, 52-65 and 71-90 each are characterized by three occurrences in the histogram whereas grayscale value 45 is characterized by 18 occurrences in the histogram and grayscale value 70 is characterized by 12 occurrences in the histogram. Continuing operation of method 1100 will be described immediately hereinafter based on histogram 1200.

Method 1100 continues at step 1114 which tests for the occurrence of a grayscale value in histogram 1200. In particular, with n=0 the presence of any pixels having grayscale level 0 is tested for in the histogram data. Since there are no occurrences of pixels at grayscale level 0, operation proceeds to step 1116 which increments the grayscale level by 1. Operation proceeds at 1120 which tests for exceeding the grayscale limit value of 127. If the grayscale limit value is identified as 128, the method ends at 1122. Otherwise, operation returns to 1114 which tests again for the occurrence of a grayscale value in histogram 1200 for the current value of n. Operation continues in a loop-wise fashion until all grayscale pixel values have been tested up to grayscale value 39. It is noted that an update cycle is not performed since grayscale values 1-39 are not present in the histogram. Returning to step 1114, however, with n set to grayscale value 40 operation proceeds to step 1124 which causes an update cycle to be performed for grayscale value 40. Thus, a confirmation of the presence any occurrences of a particular grayscale value in histogram 1200 by step 1114 produces a corresponding grayscale update cycle at step 1124. In view of the foregoing, it should be appreciated that method 1200 produces a grayscale update cycle only for grayscale values that are characterized by at least one occurrence in histogram 1200 thereby at least avoiding power consumption associated with performing update cycles that are associated with zero occurrence (e.g., missing) grayscale pixel values. In another embodiment, it is noted that the histogram data can be more limited to indicate that there is at least one occurrence of a particular grayscale value without tracking additional occurrences.

With respect to the operation of each embodiment that has been brought to light herein, it should be appreciated that the number of update cycles that are performed in order to display a given subframe can be less that the number of grayscale values that are available for display. Likewise, for a given video frame that is used to generate a set of subframes, the number of update cycles that is needed to display the given video frame While power savings that are realized through the practice of the various methods can vary on the basis of system configuration as well as the specific characteristics of an incoming video stream, Applicants have empirically demonstrated a power savings of up to 35 percent for a given video stream corresponding to a feature length film characterized by relatively low light levels using the embodiment of FIG. 9. To date, a minimum power savings of 8 percent was empirically demonstrated for a feature length cartoon that is characterized by vibrant light levels. These levels of savings are submitted by Applicants to provide a sweeping advantage over systems that perform each grayscale pixel value irrespective of whether that pixel value is actually present in the current subframe. Other benefits can include, for example, reduced circuitry degradation responsive to limiting switching activity of the electronic components.

A controller, associated apparatus and method have been described for use in conjunction with a sequential display system including a display having a plurality of pixels. Video can be displayed on the display with the video being made up of a series of frames with each frame establishing at least one gray scale value within a range of gray scale values for each pixel of the frame. During operation, a frame is analyzed, which forms one of a series of frames of the video with each frame having a frame duration, to determine at least one set of grayscale pixel values including a grayscale pixel value for each pixel of the frame (e.g., for each pixel of a set of subframes that can be produced based on the frame) with each grayscale pixel value selected from a total number of grayscale pixel values corresponding to the range of grayscale values. An initial state can be set for each pixel of the frame based on analyzing. A series of update cycles is performed based on the analyzing to establish the grayscale value of each pixel for viewing on the display based on the grayscale pixel values by selectively switching each pixel responsive to the update cycles such that a total number of the update cycles is less than the total number of pixel values.

The foregoing description of the invention has been presented for purposes of illustration and description. It is not intended to be exhaustive or to limit the invention to the precise form or forms disclosed, and other modifications and variations may be possible in light of the above teachings wherein those of skill in the art will recognize certain modifications, permutations, additions and sub-combinations thereof.

What is claimed is:

1. A method comprising:

analyzing grayscale pixel values of a subframe, which forms a portion of a series of frames of a video with each frame having a frame duration, to determine at least one set of grayscale pixel values not occurring in the subframe;

setting, at a display device comprising a plurality of pixels, each pixel to an initial state for an illuminated period corresponding to the subframe; and performing, at the display device, a series of update cycles over a number of grayscale cycles corresponding to a range of displayed grayscale values to establish a displayed grayscale value of the each pixel during the illuminated period by, for each update cycle of the series of update cycles, selectively switching pixels of the plurality of pixels having buffered pixel values corresponding to a grayscale ramp value associated with the each update cycle to a switched state, wherein, for the series of update cycles, update cycles corresponding to the at least one set of grayscale pixel values are skipped based on the analyzing.

2. The method of claim 1, wherein the video represents color video that is made up of a series of color frames and wherein the method includes generating a series of subframes for display on the display device from the color video.

3. The method of claim 2 wherein the series of subframes comprises one or more of a red subframe, a green subframe or a blue subframe.

4. The method of claim 1, wherein the grayscale ramp value is incremented by one grayscale pixel value for each grayscale update cycle.

5. The method of claim 1, wherein the at least one set of grayscale pixel values comprises a plurality of ranges within a set of available grayscale pixel values.

6. The method of claim 1, wherein the at least one set of grayscale pixel values comprises grayscale pixel values of a histogram of available grayscale pixel values associated with zero occurrences in the subframe.

7. The method of claim 6, wherein the histogram comprises histogram data indicating whether there is at least one occurrence of each grayscale pixel value of the available grayscale pixel values.

8. The method of claim 1, wherein the initial state comprises an on state for the each pixel.

9. The method of claim 1, wherein the video represents monochrome video that is made up of a series of monochrome frames and wherein the performing the series of update cycles comprises presenting a monochrome frame on the display device.

10. The method of claim 1, further comprising illuminating the display device during the illuminated period using an illumination source.

11. The method of claim 10, wherein the illumination source includes at least one light emitter in at least one of a red, a green, or a blue portion of a frequency spectrum.

12. An apparatus comprising:

a controller configured to:

analyze grayscale pixel values of a subframe, which forms a portion of a series of frames of a video with each frame having a frame duration, to determine at least one set of grayscale pixel values not occurring in the subframe;

set, at a display device comprising a plurality of pixels, each pixel to an initial state for an illuminated period corresponding to the subframe; and perform, at the display device, a series of update cycles over a number of grayscale cycles corresponding to a range of displayed grayscale values to establish a displayed grayscale value of the each pixel during the illuminated period by, for each update cycle of the series of update cycles, selectively switching pixels of the plurality of pixels having buffered pixel values corresponding to a grayscale ramp value associated with the each update cycle to a switched state, wherein, for the series of update cycles, update cycles corresponding to the at least one set of grayscale pixel values are skipped based on the analyzing.

13. The apparatus of claim 12, wherein the video represents color video that is made up of a series of color frames and wherein the controller is configured to generate a series of subframes for display on the display device from the color video.

14. The apparatus of claim 13 wherein the series of subframes comprises one or more of a red subframe, a green subframe or a blue subframe.

15. The apparatus of claim 12, wherein the grayscale ramp value is incremented by one grayscale pixel value for each grayscale update cycle.

16. The apparatus of claim 12, wherein the at least one set of grayscale pixel values comprises a plurality of ranges within a set of available grayscale pixel values.

17. The apparatus of claim 12, wherein the at least one set of grayscale pixel values comprises grayscale pixel values of a histogram of available grayscale pixel values associated with zero occurrences in the subframe.

18. The apparatus of claim 17, wherein the histogram comprises histogram data indicating whether there is at least one occurrence of each grayscale pixel value of the available grayscale pixel values.

19. The apparatus of claim 12, wherein the initial state comprises an on state for the each pixel.

20. The apparatus of claim 12, wherein the video represents monochrome video that is made up of a series of monochrome frames and wherein the controller is configured to perform the series of update cycles to present a monochrome frame on the display device.

21. The apparatus of claim 12, further comprising an illumination source for illuminating the display device during the illuminated period.

22. The apparatus of claim 21, wherein the illumination source includes at least one light emitter in at least one of a red, a green, or a blue portion of a frequency spectrum.

* * * * *